US010288064B2

(12) United States Patent
Zammuto

(10) Patent No.: US 10,288,064 B2
(45) **Date of Patent: *May 14, 2019**

(54) FLUID PUMP FOR A LINEAR ACTUATOR

(71) Applicant: Warner Electric Technology LLC, Braintree, MA (US)

(72) Inventor: Jared Ret Zammuto, Caledonia, IL (US)

(73) Assignee: Warner Electric Technology LLC, Braintree, MA (US)

( * ) Notice: Subject to any disclaimer, the term of this patent is extended or adjusted under 35 U.S.C. 154(b) by 170 days.

This patent is subject to a terminal disclaimer.

(21) Appl. No.: 15/297,177

(22) Filed: Oct. 19, 2016

(65) Prior Publication Data

US 2017/0037876 A1 Feb. 9, 2017

Related U.S. Application Data

(63) Continuation of application No. 14/082,606, filed on Nov. 18, 2013, now Pat. No. 9,500,206.

(51) Int. Cl.
*F04C 14/04* (2006.01)
*F15B 13/02* (2006.01)
(Continued)

(52) U.S. Cl.
CPC ..... *F04C 14/04* (2013.01); *F04C 2/18* (2013.01); *F15B 13/01* (2013.01); *F15B 13/022* (2013.01);
(Continued)

(58) Field of Classification Search
CPC ..... F15B 11/03; F15B 15/18; F15B 13/028; F15B 13/01; F15B 13/027;
(Continued)

(56) References Cited

U.S. PATENT DOCUMENTS 2,457,467 A * 12/1948 Hartman ..... B64C 25/22 60/460
3,481,275 A 12/1969 Gelin
(Continued)

FOREIGN PATENT DOCUMENTS

EP 0032300 A1 7/1981
JP 2006-105227 A 4/2006
(Continued)

OTHER PUBLICATIONS

Machine Translation (obtained from Japanese patent office website) of JP 2006-105227 A.
(Continued)

*Primary Examiner* — Kenneth J Hansen
(74) *Attorney, Agent, or Firm* — Reising Ethington P.C.

(57) ABSTRACT

A fluid pump for a linear actuator is provided. The pump causes a rod in the actuator to extend or retract by controlling the flow of fluid to and from portions of a fluid chamber on either side of a piston disposed within the fluid chamber and supporting the rod. The pump includes a valve structure that enables the pump to redistribute fluid obtained from one portion of the fluid chamber on one side of the piston to the other portion of the fluid chamber on the other side of the piston without first returning the fluid to a fluid reservoir thereby increasing the efficiency of the pump.

41 Claims, 4 Drawing Sheets

(51) Int. Cl.

| | |
|---|---|
| ***F04C 2/18*** | (2006.01) |
| ***F15B 15/18*** | (2006.01) |
| ***F15B 13/01*** | (2006.01) |
| ***F15B 13/04*** | (2006.01) |

(52) U.S. Cl.
CPC ..... *F15B 13/027* (2013.01); *F15B 13/028* (2013.01); *F15B 13/0401* (2013.01); *F15B 15/18* (2013.01); *F15B 2211/2053* (2013.01)

(58) Field of Classification Search
CPC ..... F15B 2211/305; F15B 2211/20515; F15B 2211/3052; F04C 14/02; F04C 14/12
USPC ..... 60/473
See application file for complete search history.

(56) References Cited

U.S. PATENT DOCUMENTS

| | | | | |
|---|---|---|---|---|
| 6,152,715 | A | 11/2000 | Kaempe et al. | |
| 6,519,939 | B1 * | 2/2003 | Duff | F15B 1/265 60/473 |
| 6,979,185 | B2 | 12/2005 | Kaempe | |
| 7,249,458 | B2 * | 7/2007 | Arbel | F04B 1/07 60/415 |
| 7,281,372 | B2 | 10/2007 | Sakai et al. | |
| 2008/0022672 | A1 | 1/2008 | He | |
| 2010/0193714 | A1 * | 8/2010 | Hankinson | F15B 1/265 251/12 |
| 2010/0242718 | A1 | 9/2010 | Willauer et al. | |
| 2010/0300279 | A1 | 12/2010 | Kadlicko et al. | |
| 2012/0220177 | A1 | 8/2012 | Tsutsui et al. | |

FOREIGN PATENT DOCUMENTS

| | | |
|---|---|---|
| JP | 2006-200598 A | 8/2006 |
| JP | 2013-024383 A | 2/2013 |

OTHER PUBLICATIONS

International Search Report issued in corresponding international application PCT/US2014/065859 (dated Mar. 9, 2015).
Written Opinion issued in corresponding international application PCT/US2014/065859 (dated Mar. 9, 2015).

* cited by examiner

FLUID PUMP FOR A LINEAR ACTUATOR

This application is a continuation of U.S. patent application Ser. No. 14/082,606 filed Nov. 18, 2013, the entire disclosure of which is incorporated herein by reference.

BACKGROUND OF THE INVENTION a. Field of the Invention

This disclosure relates to a fluid pump for a linear actuator. In particular, the instant disclosure relates to a fluid pump providing improvements in operating efficiencies, flexibility of use and packaging.

b. Background Art

In a fluid controlled linear actuator, a double acting piston is disposed within a fluid chamber and connected to an actuator rod extending from the fluid chamber. Fluid is delivered to and removed from the fluid chamber on opposite sides of the piston in order to move the piston within the chamber and extend or retract the rod. Fluid is delivered and removed from the fluid chamber using a fluid pump. Conventional fluid pumps used with linear actuators have several disadvantages. For example, conventional fluid pumps are relatively inefficient. Fluid removed from the fluid chamber on one side of the piston is returned to a fluid reservoir from which the fluid is drawn through the pump for distribution to the other side of the piston. In addition to the long fluid flow path and significant valve requirements to control fluid flow, the fluid pressure required to open valves directing fluid back to the reservoir increases pressure on the back side of the pump and increases the power required to start the pump. Conventional pumps are also relatively complex and require a large number of components to direct fluid flow within the pump thereby increasing the size of the pump and actuator. Finally, conventional fluid pumps and linear actuators must be oriented in certain ways due to the effects of gravity on fluid levels in the pump.

The inventor herein has recognized a need for a fluid pump for a linear actuator that will minimize and/or eliminate one or more of the above-identified deficiencies.

BRIEF SUMMARY OF THE INVENTION

An improved fluid pump for a linear actuator is provided. In particular, a fluid pump is provided having improvements in operating efficiencies, flexibility of use and packaging relative to conventional fluid pumps.

A fluid pump for a linear actuator in accordance with one embodiment of the present teachings includes a housing defining an inlet port configured for fluid communication with a fluid reservoir and first and second outlet ports configured for fluid communication with first and second portions of a fluid chamber formed on opposite sides of a piston disposed within the fluid chamber. The pump further includes a driven pump element disposed within the housing. The pump further includes a first shuttle disposed on a first axial side of the driven pump element and movable between a first fluid flow position permitting fluid flow between the inlet port and the driven pump element along a first fluid flow path and a second fluid flow position permitting fluid flow between the inlet port and the driven pump element along a second fluid flow path. The pump further includes a first check valve disposed on a second axial side of the driven pump element and movable between a closed position and an open position permitting fluid flow between the driven pump element and the first outlet port. The pump further includes a second check valve disposed on the second axial side of the driven pump element and movable between a closed position and an open position permitting fluid flow between the driven pump element and the second outlet port. The pump further includes a second shuttle disposed on the second axial side of the driven pump element and movable between a first position in which the second shuttle causes the first check valve to assume the open position and a second position in which the second shuttle causes the second check valve to assume the open position. Rotation of the driven pump element in a first rotational direction results in movement of the first shuttle to the first fluid flow position, movement of the first check valve to the open position and movement of the second shuttle to the second position. Rotation of the driven pump element in a second rotational direction opposite the first rotational direction results in movement of the first shuttle to the second fluid flow position, movement of the second valve to the open position and movement of the second shuttle to the first position.

A fluid pump for a linear actuator in accordance with another embodiment of the present teachings includes a housing defining an inlet port configured for fluid communication with a fluid reservoir and first and second outlet ports configured for fluid communication with first and second portions of a fluid chamber formed on opposite sides of a piston disposed within the fluid chamber. The pump further includes a driven pump element disposed within the housing. The pump further includes means for controlling fluid flow between the inlet port and the driven pump element and means for controlling fluid flow between the driven pump element and the first and second outlet ports. Rotation of the driven pump element in a first rotational direction results in fluid flow between the inlet port and the driven pump element along a first fluid flow path, fluid flow from the driven pump element to the first outlet port and fluid flow from the second outlet port to the driven pump element. Rotation of the driven pump element in a second rotational direction opposite the first rotational direction results in fluid flow between the inlet port and the driven pump element along a second fluid flow path, fluid flow from the driven pump element to the second outlet port and fluid flow from the first outlet port to the driven pump element.

A linear actuator in accordance with one embodiment of the present teachings includes a tube defining a fluid chamber, a piston disposed within the fluid chamber, and a pushrod coupled to the piston for movement with the piston. The actuator further includes a fluid pump having a housing defining an inlet port configured for fluid communication with a fluid reservoir and first and second outlet ports configured for fluid communication with first and second portions of the fluid chamber formed on opposite sides of the piston. The pump further includes a driven pump element disposed within the housing. The pump further includes a first shuttle disposed on a first axial side of the driven pump element and movable between a first fluid flow position permitting fluid flow between the inlet port and the driven pump element along a first fluid flow path and a second fluid flow position permitting fluid flow between the inlet port and the driven pump element along a second fluid flow path. The pump further includes a first check valve disposed on a second axial side of the driven pump element and movable between a closed position and an open position permitting fluid flow between the driven pump element and the first outlet port. The pump further includes a second check valve disposed on the second axial side of the driven pump element and movable between a closed position and an open position permitting fluid flow between the driven pump element and the second outlet port. The pump further includes a second shuttle disposed on the second axial side of the driven pump element and movable between a first position in which the second shuttle causes the first check valve to assume the open position and a second position in which the second shuttle causes the second check valve to assume the open position. Rotation of the driven pump element in a first rotational direction results in movement of the first shuttle to the first fluid flow position, movement of the first check valve to the open position and movement of the second shuttle to the second position. Rotation of the driven pump element in a second rotational direction opposite the first rotational direction results in movement of the first shuttle to the second fluid flow position, movement of the second valve to the open position and movement of the second shuttle to the first position. The actuator further includes a motor coupled to the driven pump element.

A fluid pump in accordance with the present teachings is advantageous relative to conventional fluid pumps for linear actuators. First, the fluid pump is more efficient than conventional fluid pumps. When the position of the actuator is changed, fluid drained from the fluid chamber on one side of the piston in the actuator is regenerated through the pump and directed to the other side of the piston as opposed to first being routed to and through the fluid reservoir. In addition to more efficiently routing fluid flow within the pump and actuator, the design reduces or eliminates pressure on the back side of the pump normally required to open valves that direct fluid to the reservoir. As a result, less power is required to activate the pump. Second, many elements in the fluid pump perform multiple functions allowing a decrease in the number of components in the pump and the size of the pump and actuator. Finally, the fluid pump and the actuator in which the pump is employed can function normally regardless of orientation of the pump and the effects of gravity on fluid within the pump.

The foregoing and other aspects, features, details, utilities, and advantages of the present teachings will be apparent from reading the following description and claims, and from reviewing the accompanying drawings.

DETAILED DESCRIPTION OF EMBODIMENTS OF THE INVENTION

Figure 1:
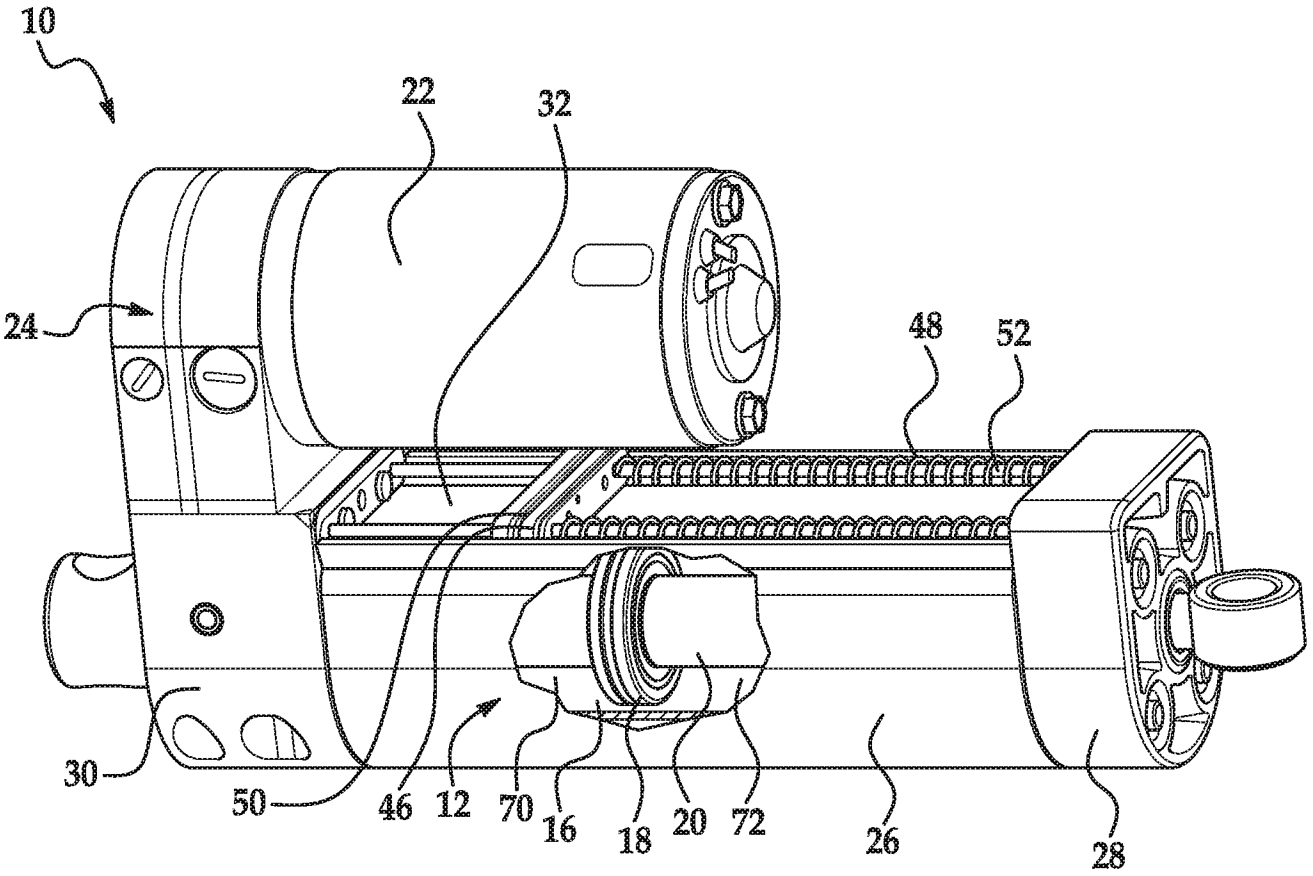
FIG. 1 is a perspective view of a linear actuator in accordance with one embodiment of the present teachings.
Figure 2:
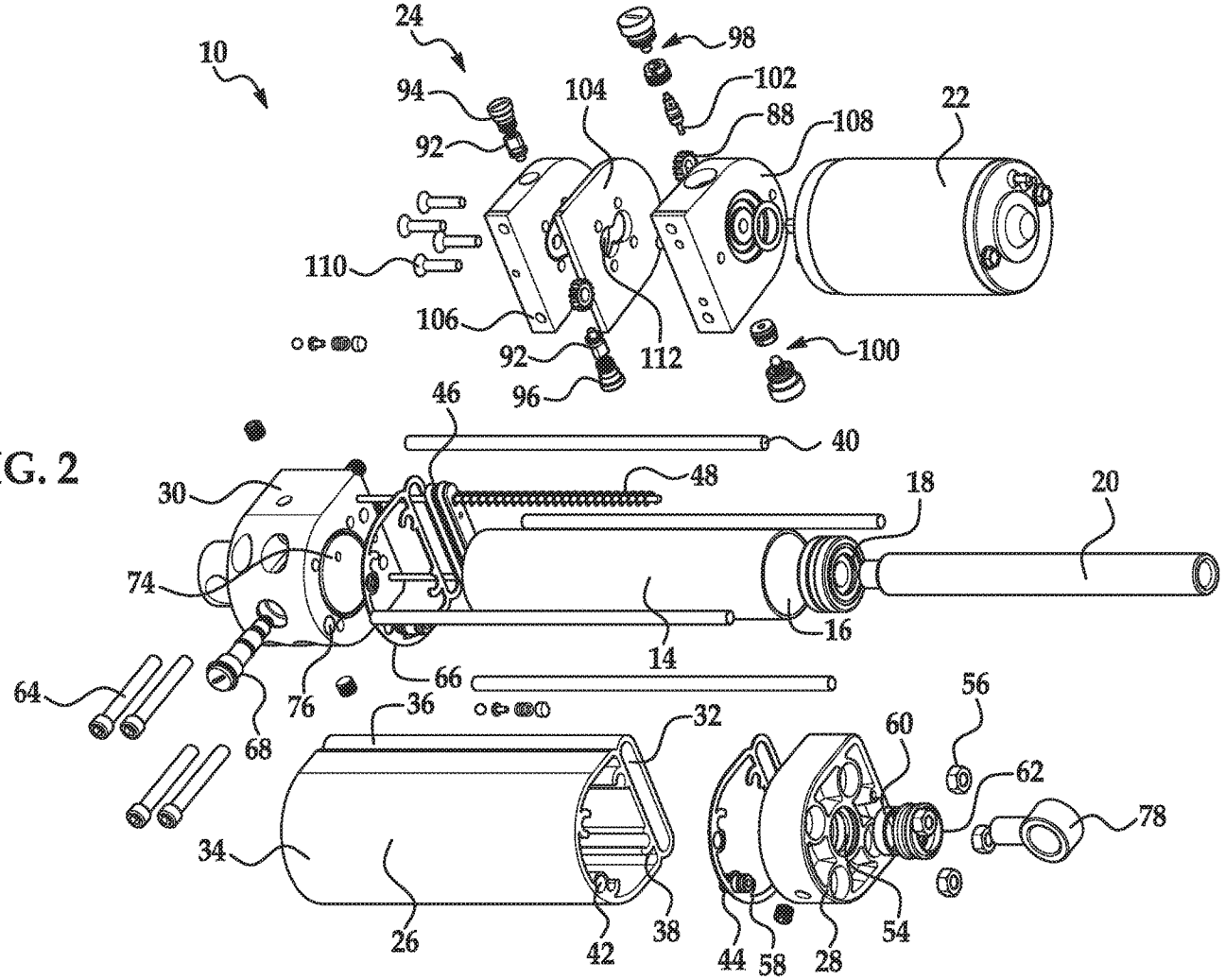
FIG. 2 is an exploded view of the actuator of FIG. 1.

Referring now to the drawings wherein like reference numerals are used to identify identical components in the various views, FIGS. 1-2 illustrate a linear actuator 10 in accordance with one embodiment of the present teachings. Actuator 10 is provided to move an object back and forth in a line along an axis. Actuator 10 may be used to push and pull an object or to lift and lower an object and may be used in a wide variety of applications including, for example, adjusting the height of vehicle components including seats and wheelchair lifts, adjusting the height of machine components including brushes and lawn mower blades and positioning conveyor guides. It should be understood that the identified applications are exemplary only. Actuator 10 may include an actuator housing 12, a tube 14 defining a fluid chamber 16, a piston 18, a rod 20, a motor 22, and a pump 24 in accordance with the present teachings.

Housing 12 provides structural support to other components of actuator 10 and prevents damage to those components from foreign objects and elements. Housing 12 may also define a fluid manifold for routing fluid between pump 24 and actuator tube 14. Housing 12 may include a main body 26, a head 28 and an end cap 30.

Body 26 is provided to support actuator tube 14. Referring to FIG. 2, body 26 further defines a fluid reservoir 32 containing fluid that may be used in retracting and/or extending actuator 10. Body 26 may be made from conventional metals or plastics. Body 26 may be divided into two sections 34, 36. Section 34 may be substantially D-shaped in cross-section and may define a plurality of circumferentially spaced C-shaped receptacles 38 on a radially inner surface configured to receive tie rods 40. Tie rods 40 may be made from elastic materials and may have threads on either end for coupling to head 28 and end cap 30. Tie rods 40 clamp tube 14 between head 28 and end cap 30, but allow head 28 and end cap 30 to separate from tube 14 to relieve pressure if the pressure in tube 14 exceeds a predetermined threshold. Section 34 may further define a fluid conduit 42 extending along the length of section 34 and configured to deliver fluid to fluid chamber 16 on the rod side of piston 18. Conduit 42 may be coupled to fluid chamber 16 using a fluid coupler 44. Section 36 of body 26 may be substantially oval in cross-section and share a common wall with section 34. Section 36 may define fluid reservoir 32. By incorporating reservoir 32 with the other components of actuator 10, the overall size of the actuator 10 and, in particular, the overall length of actuator 10 may be reduced relative to conventional actuators. In accordance with one aspect of the present teachings, actuator 10 may include means, such as lid 46 and springs 48 for varying the volume of reservoir 32.

Lid 46 seals one end of fluid reservoir 32. Lid 46 is configured to be received within section 36 of body 26 and therefore may be substantially oval. It should be understood, however, that the shape of lid 46 may vary and is intended to be complementary to the shape of fluid reservoir 32 defined by section 36 of body 26. Referring to FIG. 1 (in which a portion of section 36 of housing 12 has been removed for clarity), lid 46 may include a fluid seal 50 disposed about lid 46 and configured to prevent fluid from leaking past lid 46 and to prevent entry of air and contaminants into the fluid. Lid 46 may define one or more bores extending therethrough that are configured to receive rods 52 extending through reservoir 32. Lid 46 is supported on rods 52 and may be configured to slide linearly along rods 52 to vary the position of lid 46 and the volume of fluid reservoir 32. Appropriate fluid seals may be disposed within the bores in lid 46 surrounding rods 52.

Springs 48 provide means for biasing lid 46 in one direction. Springs 48 may be disposed about and supported on rods 52. One end of each spring 48 engages and is seated against a side of lid 46 while the opposite end may engage and be seated against a surface of head 28 at the end of reservoir 32. Springs 48 apply a relatively small biasing force to lid 46 sufficient to cause movement of lid 46 in the absence of fluid pressure or a reduction in fluid pressure in reservoir 32 and which may yield to increasing fluid pressure in the fluid in the reservoir 32.

The use of lid 46 and springs 48 provides several advantages relative to conventional actuators. For example, lid 46 and springs 48 allow the volume of the fluid reservoir 32 to vary. As a result, actuator 10 is able to handle changing fluid volumes resulting from varying displacement of fluids during extension and retraction of rod 20 in the actuator 10 as well as from thermal expansion and contraction of the fluid. The variable volume reservoir 32 also permits variation in stroke length for the actuator without the need to change the size of the reservoir housing. Springs 48 also protect against pump cavitation by transferring pressure to the fluid in reservoir 32. Further, because the spring-loaded lid 46 seals the fluid in reservoir 32 from the atmosphere regardless of orientation of actuator 10, lid 46 and springs 48 facilitate mounting of actuator 10 in a wider variety of orientations than conventional actuators including those in which gravity acting on the fluid would otherwise risk atmospheric contamination of the fluid in conventional actuators.

Referring again to FIG. 2, head 28 closes one longitudinal end of body 26 and provides an aperture 54 through which actuator rod 20 may be extended or retracted. Head 28 may also support tie rods 40 near one longitudinal end of each tie rod 40. Tie rods 40 may extend through bores in head 28 and be secured in place using nuts 56 and washers. A gasket 58 may be disposed between head 28 and body 26 to prevent fluid leakage from housing 12 as well as entry of contaminants. A wiper 60 and seals 62 may be placed within aperture 54 in order to prevent fluid leakage during extension of actuator rod 20.

End cap 30 closes the opposite longitudinal end of body 26 relative to head 28 and may support the opposite longitudinal end of each tie rod 40 relative to head 28. End cap 30 may be secured to pump 24 using conventional fasteners such as socket head cap screws 64. End cap 30 may also define at least part of a fluid manifold for transferring fluid between pump 24 and tube 14. A gasket 66 may be disposed between end cap 30 and body 26 to prevent fluid leakage from housing 12 as well as entry of contaminants. A manual release mechanism 68 may be received within end cap 30 and used to release actuator 10 in the event of a mechanical failure. Mechanism 68 may comprise a threaded needle having seals disposed about the needle. During normal operation of actuator 10, when the needle and seals are fully seated within end cap 30, mechanism 68 inhibits fluid communication among conduits leading to fluid chamber 16 and reservoir 32. Rotation of mechanism 68 unseats the needle and seals and establishes fluid communication between the conduits to relieve pressure within actuator 10 and permit manual retraction or extension of rod 20.

Tube 14 is configured to house piston 18 and at least a portion of rod 20 and defines a fluid chamber 16 in which piston 18 is disposed. Tube 14 may be cylindrical in shape and is configured to be received within body 26 of housing 12 and supported on tie rods 40 within housing 12. Referring again to FIG. 1, the fluid chamber 16 in tube 14 may be divided by piston 18 into two portions 70, 72 with one portion 70 on the rodless side of piston 18 and the other portion 72 on the rod side of piston 18. Referring again to FIG. 2, portion 70 of fluid chamber 16 may be in fluid communication with a port 74 formed in end cap 30 of housing 12. Portion 72 may be in fluid communication with fluid conduit 42 extending from another port 76 in end cap 30 and through body 26. Fluid may be introduced to and/or removed from each portion 70, 72 of chamber 16 as described hereinbelow to move piston 18 within the chamber 16 and extend or retract rod 20.

Piston 18 supports one longitudinal end of rod 20 and moves within fluid chamber 16 of tube 14 responsive to fluid pressure within chamber 16 to extend or retract rod 20. Piston 18 is circular in the illustrated embodiment. It should be understood, however, that the shape of piston 18 may vary and is intended to be complementary to tube 14. One or more fluid seals may be disposed about piston 18 to prevent fluid leakage between portions 70,72 of fluid chamber 16.

Rod 20 causes linear motion in another object (not shown). One longitudinal end of rod 20 is coupled to piston 18. The opposite longitudinal end of rod 20 may be configured as, or may support, a tool 78. It should be understood that the configuration of tool 78 may vary depending on the application of actuator 10.

Motor 22 is provided to drive pump 24 in order to displace liquid within tube 14 and extend or retract rod 20. Motor 22 may comprise an electric motor such as an alternating current motor with a stator and rotor or a brushed or brushless direct current motor. Motor 22 is coupled to pump 24 and may be orientated longitudinally in a direction parallel to actuator housing 12.

Pump 24 is provided to transfer and distribute fluid among reservoir 32 and portions 70, 72 of fluid chamber 16. Referring to FIG. 3-6, pump 24 may include a housing 80 defining an inlet port 82 and outlet ports 84, 86 and driven and idler gears 88, 90. In accordance with certain embodiments and aspects of the invention, pump 24 may further include, means, such as shuttle 92 and springs 94, 96 for controlling fluid flow between inlet port 82 and gears 88, 90, and means, such as check valves 98, 100 and shuttle 102, for controlling fluid flow between gears 88, 90 and outlet ports 84, 86.

Housing 80 provides structural support to other components of pump 24 and prevents damage to those components from foreign objects and elements. Housing 80 may include several members including gear housing member 104, inlet housing member 106 and outlet housing member 108. Referring to FIG. 2, housing members 104, 106, 108 may be coupled together using conventional fasteners 110 and may include fluid seals between adjacent members 104, 106, 108 to prevent fluid leakage.

Gear housing member 104 may be disposed between inlet and outlet housing members 106, 108. Member 104 defines a cavity 112 in the shape of two circles that open into another to form a substantially peanut shaped opening. Cavity 112 is configured to receive driven and idler gears 88, 90 and to allow teeth on gears 88, 90 to engage one another.

Figure 3:
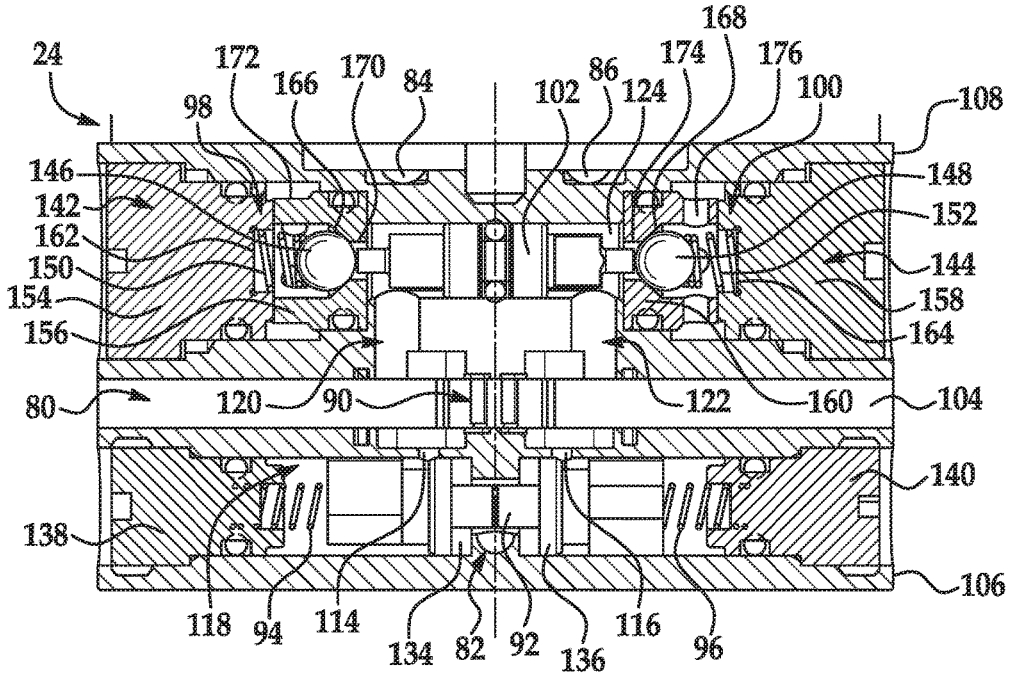
FIG. 3 is a cross-sectional view of a fluid pump in accordance with one embodiment of the present teachings illustrating the fluid pump with the actuator at rest.

Inlet housing member 106, together with end cap 30 of housing 12, defines a fluid manifold for directing fluid between fluid reservoir 32 and gears 88, 90. Referring to FIG. 3, housing member 106 defines inlet port 82 that is configured for fluid communication with reservoir 32 and a pair of pump ports 114, 116, that are in fluid communication with cavity 112 in gear housing member 104. Member 106 further defines a passageway 118 extending across member 106 configured to receive shuttle 92 and springs 94, 96.

Outlet housing member 108, together with end cap 30 of housing 12, defines a fluid manifold for directing fluid between gears 88, 90 and tube 14. Member 108 defines outlet ports 84, 86 that are configured for fluid communication with portions 70, 72 of fluid chamber 16 and a pair of conduits 120, 122 that are in fluid communication with cavity 112 in gear housing member 104. Member 108 further defines a passageway 124 extending across member 108 configured to receive check valves 98, 100 and shuttle 102.

Figure 4:
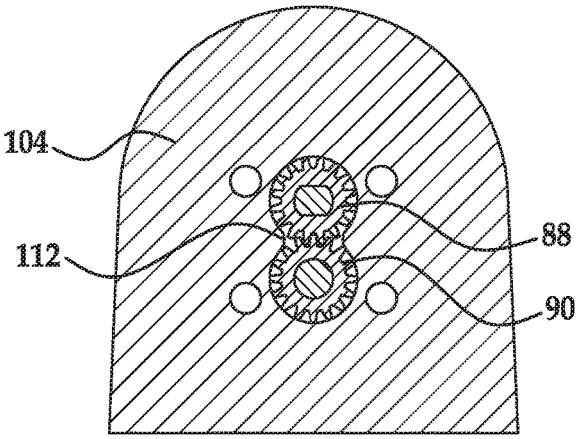
FIG. 4 is a plan view of a portion of a fluid pump in accordance with one embodiment of the present teachings.

Referring to FIG. 4, driven and idler gears 88, 90 comprise a gear pump that creates fluid pressure within pump 24 and actuator 10 to cause movement of piston 18 and extension or retraction of rod 20. Gears 88, 90 may be made from conventional metals and metal alloys or plastics. Gears 88, 90 are disposed within housing 80 and, in particular, within cavity 112 in gear housing member 104. Driven and idler gears 88, 90 are configured for rotation about parallel axes 126, 128. Driven gear 88 is supported on a shaft (not shown) extending from motor 22 and may be driven by motor 22 in either rotational direction. Idler gear 90 is supported on a parallel shaft (e.g., a dowel pin), is in mesh with driven gear 88, and rotates responsive to rotation of driven gear 88. Driven and idler gears 88, 90 rotate in opposite rotational directions and draw fluid from one side of pump 24 to the other side of pump 24. It should be understood that driven and idler gears 88, 90 are exemplary pump elements only and that other conventional pump forms could be implemented. Thus, while the pump may comprise an external gear pump having gears 88, 90 with gear 88 comprising the driven pump element, the pump may alternatively comprise, for example, a gerotor pump with the inner gear comprising a driven pump element or a radial ball piston pump with an eccentric drive shaft comprising the driven pump element.

Referring again to FIG. 3, shuttle 92 and springs 94, 96 provide means for controlling fluid flow between inlet port 82 and gears 88, 90. Shuttle 92 and springs 94, 96 are disposed on one axial side of gears 88, 90. Shuttle 92 is movable between a fluid flow position permitting fluid flow between inlet port 82 and gears 88, 90 along a fluid flow path 130 (FIG. 5) and a fluid flow position permitting fluid flow between inlet port 82 and gears 88, 90 along a fluid flow path 132 (FIG. 6) and a neutral position (FIG. 3) between the two fluid flow positions inhibiting fluid flow along both of paths 130, 132. Shuttle 92 may comprise a split shuttle (see FIG. 2) that is symmetrical in shape. Shuttle 92 may include enlarged portions 134, 136 equidistant from a longitudinal center of shuttle 92. Each portion 134, 136 of shuttle 92 may define a labyrinth seal formed in a surface of portion 134, 136 and configured to mate to a surface of inlet housing member 106 to inhibit fluid flow along paths 130, 132 when shuttle 92 is in the neutral position. Springs 94, 96 are disposed on opposite sides of shuttle 92 and bias shuttle 92 to the neutral position. Springs 94, 96 apply equal and opposing forces to shuttle 92. One end of each spring 94, 96 engages a corresponding end of shuttle 92. The opposite end of each spring 94, 96 is seated in a recess in a corresponding sealed plug 138, 140 disposed within passage 118 of inlet housing member 106.

Check valves 98, 100, and shuttle 102 provide means for controlling fluid flow between gears 88, 90, and outlet ports 84, 86. Check valves 98, 100 and shuttle 102 are disposed on an opposite axial side of gears 88, 90 relative to shuttle 92 and springs 94, 96. Check valves 98, 100 each include a valve housing 142, 144, a ball 146, 148 and a spring 150, 152, respectively. Each valve housing 142, 144 may comprise two members 154, 156 and 158, 160, respectively, sized to be received within passage 124 of outlet housing member 108. Members 154, 158 defines spring seats 162, 164 for one end of a corresponding spring 94 or 96. Members 156, 160 defines valve seats 166, 168 for balls 146, 148 opposing the spring seats 162, 164 in member 154, 158. Members 156, 160 further defines openings at one end through which shuttle 102 may extend to engage ball 146 or 148 and through which fluid may flow when the valve 98 or 100 is opened. Members 156, 160 each further define a pair of fluid ports 170, 172 and 174, 176, respectively. Balls 146, 148 are provided to seal and close the valves 98, 100 in the absence of a force on balls 146, 148 from shuttle 102 or fluid pressure. Springs 150, 152 are disposed between seats 162, 164 in members 154, 158 and balls 146, 148 and bias balls 146, 148 against valve seats 166, 168 to bias the valves 98, 100 to a closed position. Shuttle 102 is movable between a fluid flow position permitting fluid flow between outlet ports 84, 86 and gears 88, 90 along fluid flow paths 178, 180 (FIG. 5) and another fluid flow position permitting fluid flow between outlet ports 84, 86 and gears 88, 90 along fluid flow paths 178, 180 (FIG. 6) and a neutral position (FIG. 4) between the two fluid flow positions inhibiting fluid flow along both of paths 178, 180. Shuttle 102 may be symmetrical in shape with both longitudinal ends of shuttle 102 configured to be received within openings in members 156, 160 of a corresponding valve 98, 100 upon movement away from the neutral position of shuttle 102.

Figure 5:
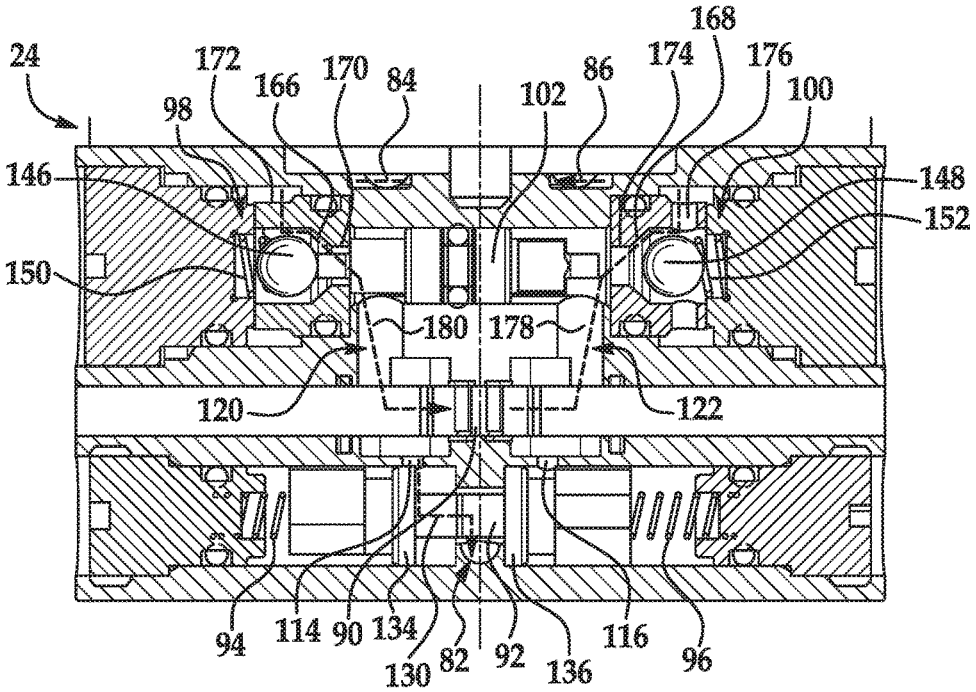
FIG. 5 is a cross-sectional view of the fluid pump of FIG. 3 illustrating operation of the fluid pump as the rod of the actuator is retracted.
Figure 6:
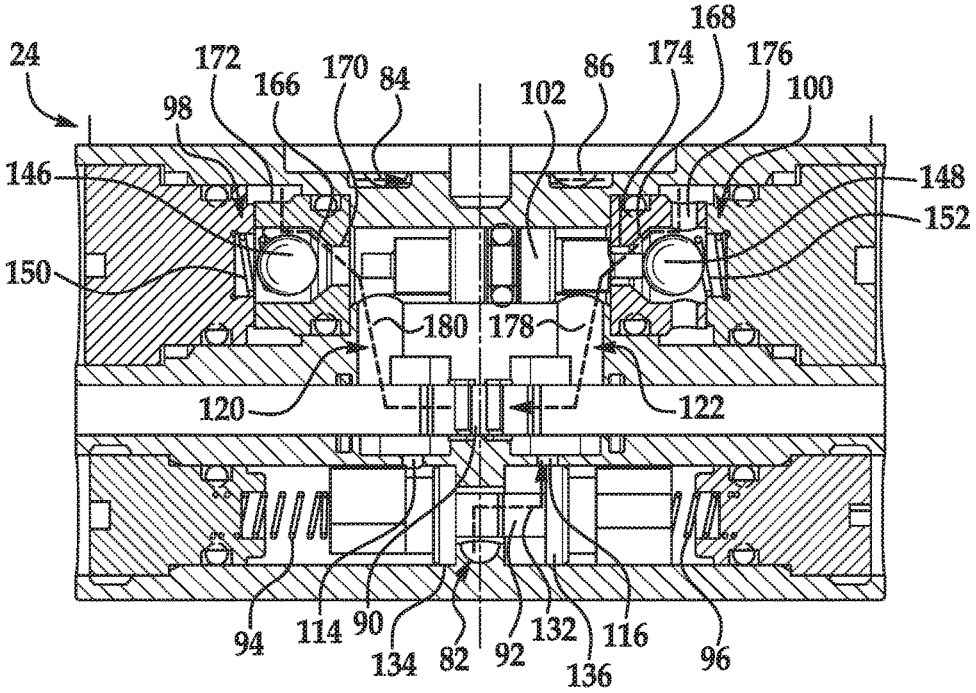
FIG. 6 is a cross-sectional view of the fluid pump of FIG. 3 illustrating operation of the fluid pump as the rod of the actuator is extended.

Referring now to FIGS. 3 and 5-6, the operation of pump 24 will be described in greater detail. FIG. 3 illustrates the state of pump 24 when the motor 22 and actuator 10 are at rest and the rod 20 of the actuator 10 is stationary (i.e. neither being extended or retracted). In this state, shuttle 92 is maintained at the neutral position by springs 94, 96 and the fluid flow paths 130, 132 (FIGS. 5 and 6) between inlet port 82 and ports 114, 116 are sealed. Springs 94, 96 maintain shuttle 92 at the neutral position despite gravitational forces thereby permitting actuator 10 to be used in more orientations than conventional devices. Shuttle 102 is likewise maintained at the neutral position as springs 150, 152 bias balls 146, 148 against valve seats 166, 168 to close check valves 98, 100.

FIG. 5 illustrates operation of pump 24 as rod 20 is being retracted. Motor 22 drives driven gear 88 in one rotational direction, causing rotation of idler gear 90 in the opposite rotational direction. Movement of gears 88, 90 pressurizes the fluid located in conduit 122 and port 116. The increasing fluid pressure in conduit 122 exerts a force on both shuttle 102 and ball 148 in valve 100. The fluid pressure on ball 148 forces ball 148 away from valve seat 168 against the force of spring 152 thereby creating fluid flow path 178. At the same time, the fluid pressure on shuttle 102 moves shuttle from its neutral position to the fluid flow position shown in FIG. 5. In this position, shuttle 102 forces ball 146 away from valve seat 166 against the force of spring 150 thereby creating fluid flow path 180. Fluid flows along path 178 from the high pressure side of gears 88, 90 through conduit 122, ports 174, 176 in valve 100 and through outlet port 86 to portion 72 of chamber 16 to act against piston 18 and cause retraction of rod 20. At the same time, fluid is displaced from portion 70 of chamber 16 by movement of piston 18. This fluid travels along fluid flow path 180, entering pump 24 at outlet port 84, travelling through ports 172, 170 of valve 98, and into conduit 120. The increasing fluid pressure in port 116 from rotation of gears 88, 90 also exerts a force on shuttle 92 that forces shuttle 92 to move from its neutral position to a the fluid flow position shown in FIG. 5. In this position, shuttle 92 prevents leakage of fluid back to inlet port 82 and reservoir 32 from the high pressure side of the pump 24. At the same time, shuttle 92 opens fluid flow path 130 from port 114 to inlet port 82. Because of the presence of rod 20 on one side of piston 18, retraction of rod 20 results in an overall decrease in fluid volume within fluid chamber 16. A portion of the fluid displaced from chamber 16 will ultimately return to reservoir 32 along path 130. In accordance with one aspect of the present invention, however, the remainder is regenerated by pump 24 and transferred from portion 70 of chamber 16 to portion 72 of chamber 16. The fluid returning to reservoir 32 travels along fluid flow path 130 from port 114 to inlet port 82. As discussed hereinabove with reference to FIGS. 1-2, reservoir 32 expands through movement of lid 46 in response to the pressure of returning fluid in order to accommodate the increase in fluid volume. Once the rod 20 has reached a predetermined position, the motor 22 halts rotation of gears 88, 90. The labyrinth seal around portion 134 of shuttle 92 will slowly leak fluid reducing fluid pressure in cavity 112, conduits 120, 122 and ports 114, 116. In the absence of the fluid pressure, springs 150, 152 bias balls 146, 148 against valve seats 166, 168 to close valves 98, 100, shuttle 102 returns to the neutral position (FIG. 3) and springs 94, 96 return shuttle 92 to its neutral position (FIG. 3).

FIG. 6 illustrates operation of pump 24 as rod 20 is being extended. Motor 22 drives driven gear 88 in the opposite rotational direction relative to the operation of the pump 24 illustrated in FIG. 5. Rotation of driven gear 88 again causes rotation of idler gear 90 in the opposite rotational direction relative to driven gear 88. Movement of gears 88, 90 pressurizes the fluid located in conduit 120 and port 114. The increasing fluid pressure in conduit 120 exerts a force on both shuttle 102 and ball 146 in valve 98. The fluid pressure on ball 146 forces ball 98 away from valve seat 166 against the force of spring 150 thereby creating fluid flow path 180. At the same time, the fluid pressure on shuttle 102 moves shuttle 102 from its neutral position to the fluid flow position shown in FIG. 6. In this position, shuttle 102 forces ball 148 away from valve seat 168 against the force of spring 152 thereby creating fluid flow path 178. Fluid flows along path 180 from the high pressure side of gears 88, 90 through conduit 120, ports 170, 172 on valve 98 and through outlet port 84 to portion 70 of chamber 16 to act against piston 18 and cause extension of rod 20. At the same time, fluid is displaced from portion 72 of chamber 16 by movement of piston 18. This fluid travels along fluid flow path 178, entering pump 24 at outlet port 94, travelling through ports 176, 174 of valve 100, and into conduit 122. The increasing fluid pressure in port 114 from rotation of gears 88, 90 also exerts a force on shuttle 92 that forces shuttle 92 to move from its neutral position to a the fluid flow position shown in FIG. 6. In this position, shuttle 92 prevents leakage of fluid back to inlet port 82 and reservoir 32 from the high pressure side of the pump 24. At the same time, shuttle 92 opens fluid flow path 132 from port 116 to inlet port 82. Because of the presence of rod 20 on one side of piston 18, extension of rod 20 results in an overall increase in fluid volume within fluid chamber 16. In accordance with one aspect of the present invention fluid is regenerated by pump 24 and transferred from portion 72 of chamber 16 to portion 70 of chamber 16. Additional fluid is drawn from reservoir 32 and travels along fluid flow path 132 from inlet port 82 to port 116. As discussed hereinabove with reference to FIGS. 1-2, reservoir 32 contracts through movement of lid 46 in response to springs 48 with the decrease in fluid pressure in reservoir 32 in order to accommodate the decrease in fluid volume. Once the rod 20 has reached a predetermined position, the motor 22 halts rotation of gears 88, 90. The labyrinth seal around portion 136 of shuttle 92 will slowly leak fluid reducing fluid pressure in cavity 112, conduits 120, 122 and ports 114, 116. In the absence of the fluid pressure, springs 150, 152 bias balls 146, 148 against valve seats 166, 168 to close valves 98, 100, shuttle 102 returns to the neutral position (FIG. 3) and springs 94, 96 return shuttle 92 to its neutral position (FIG. 3).

A fluid pump 24 in accordance with the present teachings is advantageous relative to conventional fluid pumps for linear actuators. First, the fluid pump 24 is more efficient than conventional fluid pumps. When the position of the actuator 10 is changed, fluid drained from chamber 16 on one side of the piston 18 in the actuator 10 is regenerated through the pump 24 and directed to the other side of the piston 18 as opposed to first being routed to and through the fluid reservoir 32. In addition to more efficiently routing fluid flow within the pump and actuator, the design reduces or eliminates pressure on the back side of the pump normally required to open valves that direct fluid to the reservoir. As a result, less power is required to activate the pump. Second, many elements in the fluid pump 24 perform multiple functions allowing a decrease in the number of components in the pump 24 and the size of the pump 24 and actuator 10. Third, the fluid pump 24 and actuator 10 can function normally regardless of orientation of the pump 24 and actuator 10 and the effects of gravity on fluid within the pump 24.

While the invention has been shown and described with reference to one or more particular embodiments thereof, it will be understood by those of skill in the art that various changes and modifications can be made without departing from the spirit and scope of the invention.

I claim:

1. A fluid pump for a linear actuator, comprising:

a housing defining an inlet port configured for fluid communication with a fluid reservoir and first and second outlet ports configured for fluid communication with first and second portions of a fluid chamber formed on opposite sides of a piston disposed within said fluid chamber;

a driven pump element disposed within said housing;

means for controlling fluid flow between said inlet port and said driven pump element; and, means for controlling fluid flow between said driven pump element and said first and second outlet ports wherein rotation of said driven pump element in a first rotational direction results in fluid flow between said inlet port and said driven pump element along a first fluid flow path, fluid flow from said driven pump element to said first outlet port and fluid flow from said second outlet port to said driven pump element and rotation of said driven pump element in a second rotational direction opposite said first rotational direction results in fluid flow between said inlet port and said driven pump element along a second fluid flow path, fluid flow from said driven pump element to said second outlet port and fluid flow from said first outlet port to said driven pump element.

2. The fluid pump of claim 1 wherein said means for controlling fluid flow between said inlet port and said driven pump element comprises a shuttle movable between a first fluid flow position permitting fluid flow between said inlet port and said driven pump element along said first fluid flow path and a second fluid flow position permitting fluid flow between said inlet port and said driven pump element along said second fluid flow path.

3. The fluid pump of claim 2 wherein said shuttle is movable to a neutral position between said first and second fluid flow positions.

4. The fluid pump of claim 3 wherein said shuttle defines first and second labyrinth seals configured to inhibit fluid flow along said first and second fluid flow paths when said shuttle is in said neutral position.

5. The fluid pump of claim 2 further comprising first and second springs disposed on opposite sides of said shuttle and biasing said shuttle to a neutral position different from said first and second fluid flow positions.

6. The fluid pump of claim 5 wherein said shuttle inhibits fluid flow along said first and second fluid flow paths when in said neutral position.

7. The fluid pump of claim 2 wherein said first and second fluid flow paths do not extend around either longitudinal end of said shuttle.

8. The fluid pump of claim 2 wherein the shuttle comprises a split shuttle having first and second members capable of movement relative to one another.

9. The fluid pump of claim 8 wherein the shuttle is movable to a neutral position between said first and second fluid flow positions.

10. The fluid pump of claim 9 wherein the first and second members of the shuttle abut one another when the shuttle is in the neutral position.

11. The fluid pump of claim 9 wherein said shuttle defines first and second labyrinth seals configured to inhibit fluid flow along said first and second fluid flow paths when said shuttle is in said neutral position.

12. The fluid pump of claim 8 further comprising first and second springs disposed on opposite sides of said shuttle and biasing said shuttle to a neutral position different from said first and second fluid flow positions.

13. The fluid pump of claim 12 wherein said shuttle inhibits fluid flow along said first and second fluid flow paths when in said neutral position.

14. The fluid pump of claim 8 wherein said means for controlling fluid flow between said driven pump element and said first and second outlet ports comprises:

a first check valve disposed on a second axial side of said driven pump element and movable between a closed position and an open position permitting fluid flow between said driven pump element and said first outlet port;

a second check valve disposed on said second axial side of said driven pump element and movable between a closed position and an open position permitting fluid flow between said driven pump element and said second outlet port; and, a second shuttle disposed movable between a first position in which said second shuttle causes said first check valve to assume said open position and a second position in which said second shuttle causes said second check valve to assume said open position.

15. The fluid pump of claim 8 wherein said first and second fluid flow paths do not extend around either longitudinal end of said shuttle.

16. The fluid pump of claim 8 wherein the first and second members of the shuttle are spaced from one another when the shuttle is in the first fluid flow position to permit fluid flow between said inlet port and said driven pump element along the first fluid flow path and when the shuttle is in the second fluid flow position to permit fluid flow between said inlet port and said driven pump element along the second fluid flow path.

17. The fluid pump of claim 1 wherein said means for controlling fluid flow between said driven pump element and said first and second outlet ports comprises:

a first check valve disposed on a second axial side of said driven pump element and movable between a closed position and an open position permitting fluid flow between said driven pump element and said first outlet port;

a second check valve disposed on said second axial side of said driven pump element and movable between a closed position and an open position permitting fluid flow between said driven pump element and said second outlet port; and, a shuttle disposed movable between a first position in which said shuttle causes said first check valve to assume said open position and a second position in which said shuttle causes said second check valve to assume said open position.

18. A fluid pump for a linear actuator, comprising:

a housing defining an inlet port configured for fluid communication with a fluid reservoir and first and second outlet ports configured for fluid communication with first and second portions of a fluid chamber formed on opposite sides of a piston disposed within said fluid chamber;

a driven pump element disposed within said housing;

a first shuttle movable between a first fluid flow position permitting fluid flow between said inlet port and said driven pump element along a first fluid flow path and a second fluid flow position permitting fluid flow between said inlet port and said driven pump element along a second fluid flow path;

a first check valve movable between a closed position and an open position permitting fluid flow between said driven pump element and said first outlet port;

a second check valve movable between a closed position and an open position permitting fluid flow between said driven pump element and said second outlet port; and, a second shuttle movable between a first position in which said second shuttle causes said first check valve to assume said open position and a second position in which said second shuttle causes said second check valve to assume said open position;

wherein rotation of said driven pump element in a first rotational direction results in movement of said first shuttle to said first fluid flow position, movement of said first check valve to said open position and movement of said second shuttle to said second position and rotation of said driven pump element in a second rotational direction opposite said first rotational direction results in movement of said first shuttle to said second fluid flow position, movement of said second check valve to said open position and movement of said second shuttle to said first position wherein said first shuttle is movable to a neutral position between said first and second fluid flow positions and said first shuttle inhibits fluid flow along said first and second fluid flow paths when in said neutral position.

19. The fluid pump of claim 18 wherein each of said first and second check valves includes:

a valve housing defining first and second fluid ports;

a ball disposed within said valve housing; and, a spring biasing said ball against a valve seat formed in said valve housing between said first and second fluid ports to prevent fluid flow between said first and second fluid ports.

20. The fluid pump of claim 18 wherein said first shuttle defines first and second labyrinth seals configured to inhibit fluid flow along said first and second fluid flow paths when said first shuttle is in said neutral position.

21. The fluid pump of claim 18 further comprising first and second springs disposed on opposite sides of said first shuttle and biasing said first shuttle to said neutral position.

22. The fluid pump of claim 18 wherein the first shuttle comprises a split shuttle having first and second members capable of movement relative to one another.

23. The fluid pump of claim 22 wherein the first and second members of the first shuttle abut one another when the first shuttle is in the neutral position.

24. The fluid pump of claim 22 wherein the first and second members of the first shuttle are spaced from one another when the first shuttle is in the first fluid flow position to permit fluid flow between said inlet port and said driven pump element along the first fluid flow path and when the first shuttle is in the second fluid flow position to permit fluid flow between said inlet port and said driven pump element along the second fluid flow path.

25. The fluid pump of claim 22 wherein each of said first and second check valves includes:

a valve housing defining first and second fluid ports;

a ball disposed within said valve housing; and, a spring biasing said ball against a valve seat formed in said valve housing between said first and second fluid ports to prevent fluid flow between said first and second fluid ports.

26. The fluid pump of claim 22 wherein said first shuttle defines first and second labyrinth seals configured to inhibit fluid flow along said first and second fluid flow paths when said first shuttle is in said neutral position.

27. The fluid pump of claim 22 further comprising first and second springs disposed on opposite sides of said first shuttle and biasing said first shuttle to said neutral position.

28. A linear actuator, comprising:

a tube defining a fluid chamber;

a piston disposed within said fluid chamber;

a pushrod coupled to said piston for movement with said piston;

a fluid pump including:

a housing defining an inlet port configured for fluid communication with a fluid reservoir and first and second outlet ports configured for fluid communication with first and second portions of said fluid chamber formed on opposite sides of said piston;

a driven pump element disposed within said housing;

a first shuttle movable between a first fluid flow position permitting fluid flow between said inlet port and said driven pump element along a first fluid flow path and a second fluid flow position permitting fluid flow between said inlet port and said driven pump element along a second fluid flow path;

a first check valve movable between a closed position and an open position permitting fluid flow between said driven pump element and said first outlet port;

a second check valve movable between a closed position and an open position permitting fluid flow between said driven pump element and said second outlet port; and, a second shuttle movable between a first position in which said second shuttle causes said first check valve to assume said open position and a second position in which said second shuttle causes said second check valve to assume said open position;

wherein rotation of said driven pump element in a first rotational direction results in movement of said first shuttle to said first fluid flow position, movement of said first check valve to said open position and movement of said second shuttle to said second position and rotation of said driven pump element in a second rotational direction opposite said first rotational direction results in movement of said first shuttle to said second fluid flow position, movement of said second check valve to said open position and movement of said second shuttle to said first position;

wherein said first shuttle is movable to a neutral position between said first and second fluid flow positions and said first shuttle inhibits fluid flow along said first and second fluid flow paths when in said neutral position; and, a motor coupled to said driven pump element.

29. The linear actuator of claim 28 wherein each of said first and second check valves includes:

a valve housing defining first and second fluid ports;

a ball disposed within said valve housing; and, a spring biasing said ball against a valve seat formed in said valve housing between said first and second fluid ports to prevent fluid flow between said first and second fluid ports.

30. The linear actuator of claim 28 wherein said first shuttle defines first and second labyrinth seals configured to inhibit fluid flow along said first and second fluid flow paths when said first shuttle is in said neutral position.

31. The linear actuator of claim 28 further comprising first and second springs disposed on opposite sides of said first shuttle and biasing said first shuttle to said neutral position.

32. The linear actuator of claim 28 wherein rotation of said driven pump element in said first rotational direction results in fluid flow from said driven pump element back to said reservoir and rotation of said driven pump element in said second rotational direction results in fluid flow from said reservoir to said driven pump element.

33. The linear actuator of claim 28 further comprising:

a lid disposed within said fluid reservoir; and, means for biasing said lid in a first direction wherein said lid is movable within said reservoir in response to fluid pressure acting in a second direction, opposite said first direction, to vary the fluid volume of said fluid reservoir.

34. The linear actuator of claim 28 wherein the first shuttle comprises a split shuttle having first and second members capable of movement relative to one another.

35. The linear actuator of claim 34 wherein the first and second members of the first shuttle abut one another when the first shuttle is in the neutral position.

36. The linear actuator of claim 34 wherein the first and second members of the first shuttle are spaced from one another when the first shuttle is in the first fluid flow position to permit fluid flow between said inlet port and said driven pump element along the first fluid flow path and when the first shuttle is in the second fluid flow position to permit fluid flow between said inlet port and said driven pump element along the second fluid flow path.

37. The linear actuator of claim 34 wherein each of said first and second check valves includes:

a valve housing defining first and second fluid ports;

a ball disposed within said valve housing; and, a spring biasing said ball against a valve seat formed in said valve housing between said first and second fluid ports to prevent fluid flow between said first and second fluid ports.

38. The linear actuator of claim 34 wherein said first shuttle defines first and second labyrinth seals configured to inhibit fluid flow along said first and second fluid flow paths when said first shuttle is in said neutral position.

39. The linear actuator of claim 34 further comprising first and second springs disposed on opposite sides of said first shuttle and biasing said first shuttle to said neutral position.

40. The linear actuator of claim 34 wherein rotation of said driven pump element in said first rotational direction results in fluid flow from said driven pump element back to said reservoir and rotation of said driven pump element in said second rotational direction results in fluid flow from said reservoir to said driven pump element.

41. The linear actuator of claim 34 further comprising:

a lid disposed within said fluid reservoir; and, means for biasing said lid in a first direction wherein said lid is movable within said reservoir in response to fluid pressure acting in a second direction, opposite said first direction, to vary the fluid volume of said fluid reservoir.

* * * * *